United States Patent [19]

Jackson

[11] 4,008,944

[45] Feb. 22, 1977

[54] GLOW PLUG CONNECTOR

[76] Inventor: Calvin E. Jackson, Rte. 2, Box 197, Chouteau, Okla. 74337

[22] Filed: Mar. 8, 1976

[21] Appl. No.: 664,537

[52] U.S. Cl. ..... 339/253 R; 123/143 C

[51] Int. Cl.[2] ..... H01R 13/10

[58] Field of Search ..... 339/203, 252, 253, 255, 339/256, 258, 262; 123/143 C, 145 A, 148 A; 317/98

[56] References Cited

UNITED STATES PATENTS

| | | | |
|---|---|---|---|
| 954,872 | 4/1910 | Mosler | 339/258 C |
| 3,038,971 | 6/1962 | Weymouth | 339/255 R |

*Primary Examiner*—Joseph H. McGlynn
*Attorney, Agent, or Firm*—Head, Johnson & Chafin

[57] ABSTRACT

A glow plug connector for operably connecting a power source to the glow plug of a model engine. The connector has a center pole snap on lead which is configured to receive the center pole of a glow plug. A second ground lead is configured in the form of a helical coil for surrounding the glow plug body and being contactable with the engine head for completing an electrical circuit through the glow plug. The connector is designed to permit attachment and quick disconnect capabilities with one hand.

9 Claims, 6 Drawing Figures

GLOW PLUG CONNECTOR

BACKGROUND OF THE INVENTION

1. Field of the Invention

The present invention relates to an electrical connector, and more particularly, but not by way of limitation, to a glow plug connector for operably connecting a power source to a model engine glow plug.

2. Description of the Prior Art

For many years, hobbiests have been utilizing a small internal combustion engine for driving model airplanes, cars and the like. The ignition system for these small engines consists of a glow plug which is threadedly mounted through the head of the engine into open communication with the engine cylinder. The plug comprises a metallic threaded body member and a center pole probe which is mounted through the center of the plug body and insulated therefrom. The inside end of the center pole is connected to the plug body by means of a filament wire which is used as a heating coil. In order to cause initial combustion within the engine cylinder, normally one pole of a 1.5 volt battery is connected to the center pole of the glow plug and the other pole of the battery is connected to the plug body or to the engine head for completing an electrical circuit through the filament wire of the glow plug. When the filament wire becomes sufficiently hot to cause ignition of the gases within the chamber the engine may be started. After sufficient engine heat is developed within the cylinder to keep the filament wire hot, the battery or power source may be disconnected from the glow plug, the engine heat being sufficient to sustain its own firing.

There are many ways to connect the battery leads to the glow plug arrangement but the most common is the use of lead wires having alligator type clips associated therewith. One alligator clip is connected to the center pole of the glow plug and the other to some metallic portion of the engine head. This method, while workable is undesirable and can even be dangerous. Unless great care is taken, the alligator clips may both come into contact with the cylinder head, thereby causing an electrical short. Further, usually associated with an engine of this sort is a fast turning propeller which may cause damage upon coming into contact with the electrical leads. Further, it is desirable for the leads to be disconnectable or with one hand since the other hand is needed to hold the model in place after the engine is started.

Other attempts have been made to develop a single unit connector which connects one lead of the battery through the center pole of the glow plug and the other lead to somewhere on the engine body to complete the circuit. However, most of these units have been unsuccessful in withstanding the vibration normally associated with starting of a model airplane type engine.

SUMMARY OF THE INVENTION

The present invention provides a glow plug connector which is particularly designed and constructed for overcoming the above disadvantages. The connector generally comprises an elongated plate member of insulated material having a bore adjacent one end thereof. A center pole connector member is attached to one side of the opposite end of the plate member on one face with a center pole attachment clip at the opposite end thereof extending across the bore. A ground wire connector is attached to the plate at the end opposite the bore and is attached to the opposite face of the plate from the first connector. This insulates the two connectors from any contact with each other. The ground wire connector is provided with a helical coil forming a compression spring which is larger than the bore through the plate and surrounds the bore with its helical centerline axis being in alignment with the center line axis of the bore. The connector elements are then connected by means of wire leads to a power source which is usually an ordinary 1.5 volt dry cell battery.

Attachment of the connector to the glow plug is accomplished in the following manner: The helical compression spring of the ground connector is placed around the glow plug body on top of the cylinder head. The entire connector is then pressed downwardly against the pressure of the ground connector spring, allowing the center pole of the glow plug to extend through the bore of the connector plate and into locking engagement with the center pole connector lead. When the end of the glow plug center pole is firmly attached to the center pole connector, the connector then is locked into engagement for completing the circuit between the center pole and the plug body through the filament wire.

The connector may be quickly disconnected by simply lifting the end of the insulated plate to which the power source is connected thereby forcing the opposite end thereof downwardly against the cylinder head which pops the end of glow plug center pole loose from the center pole connector lead which permits easy removal from the engine. Since the connector member is elongated in shape, the battery lead wires are held away from any fast moving propeller or the like thereby greatly lessening the danger of tangling the said wires in the moving propeller.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1:
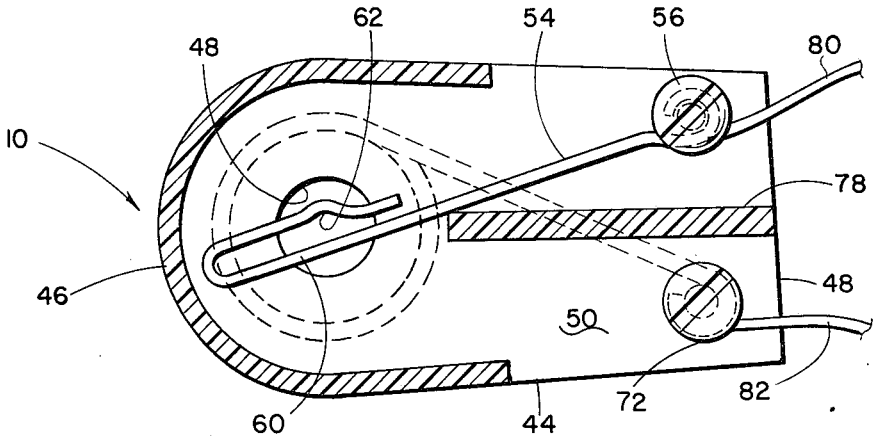
FIG. 1 is a plan view, partially in section, of a glow plug connector embodying the present invention.
Figure 2:
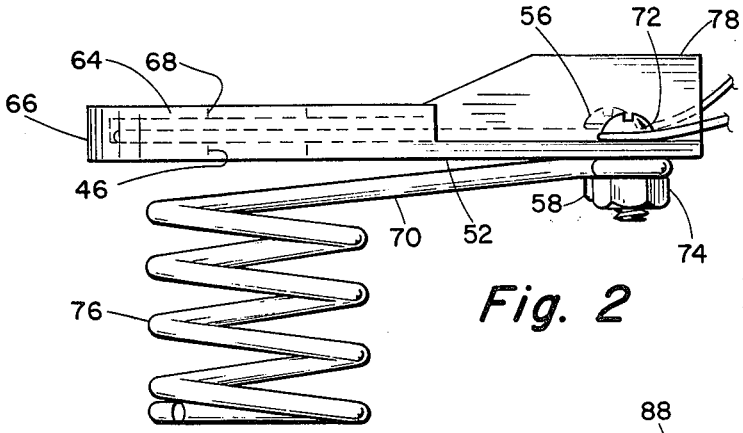
FIG. 2 is a side elevational view of the connector of FIG. 1.

Referring to the drawings in detail, reference character 10 generally indicates a glow plug connector for electrically connecting a power source 14 to a glow plug 16 for model airplane engines and the like having cylinder heads generally indicated by reference character 17.

The cylinder head 17 of a model internal combustion engine normally comprises a cylinder head combustion surface 20 which is in communication with a piston cylinder (not shown). The opposite surface of cylinder head 17 is normally provided with a series of cooling fins or plates 22 having a centrally disposed cylindrical recess 24 therein. The center of the head member 18 is provided with a threaded bore 26 therethrough into communication with the cylinder.

The glow plug 16 normally comprises a body portion 28 having a threaded end member 30 and disposed a central bore 32 therethrough. The body portion 28 is constructed of a metallic alloy which is electrically conductive. The glow plug is also provided with an elongated center pole which is centrally mounted within the bore 32 and insulated from the glow plug body 28 by means of an insulative sleeve 36. One end of the center pole 34 is normally provided with a spherical knob 38 for a purpose that will hereinafter be set forth. The opposite end of the center pole 34 extends into the bore 32 of the glow plug and is electrically connected to the body 28 thereof by means of a fine filament wire 40. When an electrical direct current power source of sufficient potential is connected across the center pole 34 and the plug body 28, electrical current passing through the filament 40 will cause the filament 40 to heat up to a sufficient temperature to ignite the fuel air mixture which is present within the engine cylinder. After the engine has been started, the heat generated within the piston cylinder is normally sufficient to keep the filament wire 40 heated to a temperature to maintain fuel combustion within the cylinder chamber.

The connector 10 generally comprises an elongated flat plate 44 which is made of plastic or other insulation material. One end of the plate 44 is provided with a rounded end portion 46 while the opposite end 48 may be flat or any other desired shape. It is noted that the end 46 may be shaped otherwise, but rounded is desirable. Centrally located in the rounded end 46 of the plate 44 is a bore 48 therethrough. For purposes of description, one face of the plate 44 will be designated by reference character 50 while the opposite surface thereof will be designated 52.

An elongated conductive lead member 54 is secured at one end thereof to the surface 50 at the flattened end portion 48 of the plate 44. The conductor 54 may be secured by any well known manner such as by the threaded screw and nut members 56 and 58. The conductive lead member 54 extends along the surface 50 of the plate 44 directly across the bore 48. The unconnected end of the conductor lead 54 is U-shaped to form a clip portion 60. The clip portion 60 is provided with an enlargement at 62 for receiving the knob 38 of the glow plug 16 therethrough in a manner that will be hereinafter set forth.

The plate member 54 may be provided with a second parallel plate member 64 which is spaced from the surface 50 and completely covers the rounded end portion 46 thereof. The means for spacing the plate 64 from the surface 50 is by way of an elongated plastic or otherwise insulative strip 66 which in effect connects the rounded plate 64 to the rounded end portion 46 of the plate 44. The plate 64 is also provided with a bore 68 therethrough which is similar to the bore 46 and in alignment therewith.

A second elongated conductive lead 70 has one end thereof secured to the surface 52 of the plate 44 at the blunted end 48 thereof opposite the attachment for the lead 54. This attachment can likewise be made by threaded screw and nut members 72 and 74. The free end of the conductive lead 70 extends across the surface 52 of the plate 44 and terminates in a helical spring member 76, the center line axis thereof being in alignment with the center line axis of the bores 46 and 68. It is readily seen and shown in the drawings that the plate members 44 and 64 and their connecting strip 66 may be constructed of a single piece of insulated material. Likewise the conductive lead 70 and helical spring 76 may be of a single piece of conductive material.

The surface 50 of the plate member 44 is provided with a partition strip member 78 which extends outwardly between the connection members or screws 56 and 72. When conductive lead wires such as those shown in FIG. 1 as reference characters 80 and 82 are connected to the screw members 56 and 72, the plate 78 will serve to keep the leads separated to prevent inadvertent shorting therebetween. It is also noted that the partition plate 78 may be constructed as an integral part of the plate member 44.

Figure 3:
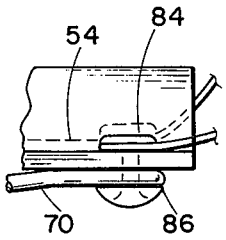
FIG. 3 represents an alternate means for attaching the connector leads of the connector of FIG. 1.

FIG. 3 shows an attachment of the conductor members 54 and 79 by means of rivet members 84 and 86, respectively.

Figure 4:
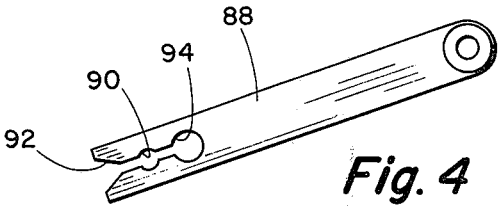
FIG. 4 depicts an alternate center pole connector means.

Referring to FIG. 4, reference character 88 generally indicates a flat metallic conductive strip which can be used in place of the conductor 54 shown in FIG. 1. In this case, the conductive strip 88 has at one end thereof a slotted aperture 90 which is sized to permit receiving the knob 38 of the glow plug 16 therethrough. The slot 90 is provided with a V-shaped opening 92 at the outer end thereof and a circular opening 94 at the other end. In this case, the connector may be attached to the center pole 34 of the glow plug by either inserting the knob through the opening 94 and pulling it through to the aperture 90 or by placing the V-shaped opening 92 below the knob 38 and pushing the strip so that the center pole 34 comes in contact with the aperture 90. By using a spring temper type material for the plate 88, it is seen that the slotted aperture 90 provides the effect of being spring loaded for gripping the center pole 34 of the glow plug.

Figure 5:
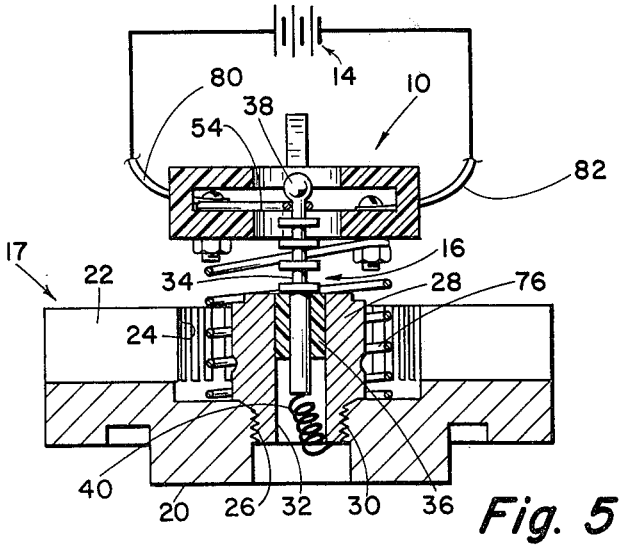
FIG. 5 is a sectional view of the connector of FIG. 1 attached to a glow plug and cylinder head.

Referring now to FIG. 5, when it is desirable to attach the power source 14 to a glow plug by means of a connector 10, the connector is placed over the glow plug allowing the compression spring 76 to surround the plug body 28 inside the recess 24 of the cylinder head. The connector is then pushed downwardly, allowing the center pole knob 38 to extend through the bore 46 and through the recess 62 of the conductive lead 54. When the recess 62 has passed the knob 38, it will then grip the lower portion of the knob 38 against the pressure of the compression spring 76 and will thereby be locked in place. The conductive lead 54 is attached by means of the lead wire 80 to one pole of the battery 14 and the conductive spring member 70 is attached by the lead wire 82 to the opposite pole of the battery which will complete the electrical circuit through the filament wire 40 for the glow plug 16.

It is seen that upon pushing the attachment portion 60 of the conductor lead 54 against the center pole knob, that the plate member 64 will prevent the conductor 54 from being pushed away from the surface 50 of the plate 54.

When it is desirable to remove the connector 10, the flattened end portion 48 is then lifted thereby pushing the rounded end portion 46 down against the cylinder head surface 22 which will snap the attachment means 60 of the connector 54 loose from the knob 38 of the glow plug center pole 34 for easy removal thereof.

Figure 6:
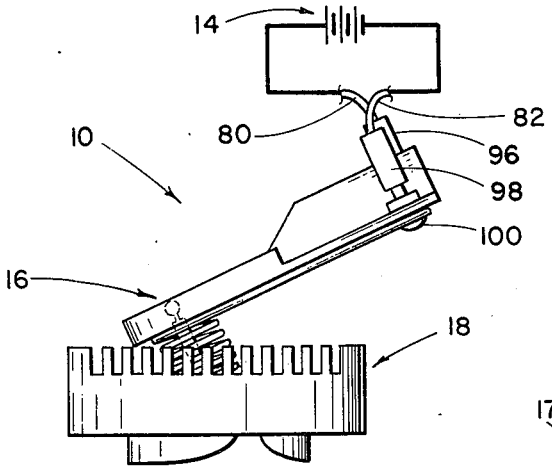
FIG. 6 is an elevational view of the connector of FIG. 3 being attached to a cylinder head having an angle-mounted glow plug.

Referring now to FIG. 6, it is readily seen that the connector 10 may be attached to the cylinder head 18 having a slant mounted glow plug herein in the manner shown. FIG. 6 also depicts an alternate method of attaching the lead wires 80 and 82 to the connector by means of plugs 96 and 98 and corresponding receptacles 100, only one of which is shown.

Whereas, the invention has been described in particular relation to the drawings attached hereto, it is obvious that other and further modifications apart from those shown or suggested herein may be made within the spirit and scope of this invention.

What is claimed:

1. A glow plug connector comprising an insulated plate member having an aperture therethrough for receiving a center pole of a glow plug therethrough, a first conductive elongated lead member having one end secured to one surface of the plate member, the opposite end portion extending across said aperture for selective locking engagement with the glow plug center pole, second conductive elongated lead member having one end secured to the opposite surface of the plate member, the other end portion having yieldable means being conductively engageable with the glow plug when said first lead member is in a lock position for completing an electrical circuit through the glow plug.

2. A glow plug connector as set forth in claim 1 wherein the first mentioned lead member is fastened to the surface of the plate member by means which also permits the attachment of a power source lead wire and the opposite end portion comprises a bent wire forming a yieldable aperture disposed in substantial alignment with the center of the plate aperture for removably receiving an enlarged end of the glow plug center pole therethrough for selectively locking said first lead member in engagement with said center pole.

3. A glow plug connector as set forth in claim 1 wherein the first mentioned lead member is fastened to one surface of the plate member by means which also permits the attachment of the power source lead wire and the opposite lead portion comprises a flattened strip of conductive material having a yieldable slot therein for selectively locking said strip and conductive engagement with an enlarged end of the glow plug center pole.

4. A glow plug connector as set forth in claim 1 wherein the second lead member is fastened to the other surface of the plate member by means which also permits the attachment of a second power source lead wire and the end portion comprises a helical compression spring having a center axis in alignment with the plate aperture, said spring having a radius larger than that of said plate aperture, said spring having a length such that compression thereof between the plate member and the conductive engagement of the glow plug is required in order to lockingly engage the first lead member to the glow plug center pole.

5. A glow plug connector as set forth in claim 1 including lead member retaining means carried by the plate member and engageable with the free end portion of the first mentioned lead member end portion in place with respect to the plate aperture.

6. A glow plug connector as set forth in claim 1 wherein the first mentioned lead member is attached to the one surface of the plate member by means which also permits the attachment of a power source lead wire, and wherein the second mentioned lead member is likewise attached to the other face of the plate member by means which also permits the attachment of a second power source lead wire, including a nonconductive separation plate carried by the plate member and disposed between the means for attaching the first and second lead members to prevent inadvertent shorting therebetween when power source lead wires are connected thereto.

7. A glow plug connector as set forth in claim 6 wherein the means for attaching the first and second lead wires to the plate member comprise threaded screw and nuts.

8. A glow plug connector as set forth in claim 6 wherein the means for attaching a first and second lead wires to opposite surfaces and faces of the plate member comprise brad members having power source lead wires secured thereto.

9. A glow plug connector for use in conjunction with a model engine having cylinder head means of conductive material and a glow plug threadedly attached thereto the glow plug having a center pole member which is electrically connected to said cylinder head means through a heater element, said connector comprising an insulative plate member having an aperture therethrough for receiving the center pole of the glow plug therethrough, a first conductive elongated lead member having one end secured to one face of the plate member, the opposite end portion extending across said aperture having means for selective locking engagement with the center pole glow plug, a second conductive elongated lead member having one end secured to the opposite face of the plate member, the other end portion having yieldable means and being conductively engageable with the cylinder head means when said first lead member is in locked engagement with the glow plug center pole for completing an electrical circuit through the glow plug.

* * * * *